US005337417A

United States Patent [19]

Whiteside et al.

[11] Patent Number: 5,337,417

[45] Date of Patent: Aug. 16, 1994

[54] RIB PROTECTOR

[75] Inventors: Dennis K. Whiteside, St. Charles; Donald R. Walker; Norma L. Denney, both of Ava, all of Mo.

[73] Assignee: Figgie International Inc., Willoughby, Ohio

[21] Appl. No.: 111,987

[22] Filed: Aug. 25, 1993

[51] Int. Cl.[5] ..... A41D 13/00

[52] U.S. Cl. ..... 2/2; 2/44; 2/311; 2/268; 2/336; 2/338

[58] Field of Search ..... 2/2, 44, 311, 268, 336, 2/338, 312; 602/19, 20; 482/106, 139; 450/155

[56] References Cited

U.S. PATENT DOCUMENTS 1,640,654 8/1927 Goldsmith et al. .
2,108,336 2/1938 Helland .
2,163,463 6/1939 Kennedy .
3,166,760 1/1965 Rasmussen .
3,739,397 6/1973 Truelove .
3,921,222 11/1975 Hollman .
3,945,041 3/1976 Rhee .
4,135,252 1/1979 Latina et al. .
4,317,237 3/1982 Porte .
4,425,667 1/1984 Harrison .
4,481,679 11/1984 Hayes ..... 2/2
4,642,814 2/1987 Godfrey .
5,029,341 7/1991 Wingo, Jr. ..... 2/2

*Primary Examiner*—Clifford D. Crowder
*Assistant Examiner*—Gloria Hale
*Attorney, Agent, or Firm*—Senniger, Powers, Leavitt & Roedel

[57] ABSTRACT

A rib protector is disclosed for protecting a player's torso while playing athletic events, such as football. The rib protector includes an pad having an inner surface and an outer surface opposite the inner surface. A flexible belt is attached to the outer surface of the pad for securing the pad around the player's torso in a position in which the inner surface of the pad is adjacent the torso. A plurality of removable plates are attached to the belt for covering portions of the outer surface of the pad. The plates are constructed for receiving the impact of blows delivered to the rib protector and distributing the impact force to the pad. The plates are separate from one another and individually removable from the belt whereby a player using the rib protector may attach a selected number of plates to the belt.

22 Claims, 5 Drawing Sheets

11
31
35
23
39
41
15
49
19
59
45
63
65
61
43
29
3
47
33
37
21

11
21
17
15
45
59
63
65
29
23
49
31

RIB PROTECTOR

SUMMARY OF THE INVENTION

This invention relates generally to athletic equipment, and more particularly to a rib protector for protecting a player's torso during athletic events, such as football.

In certain athletic events, including football, a player wears a shoulder pad for cushioning blows directed to the player's upper body. Conventional shoulder pads, however, do not protect the player's ribs from injury. In order to prevent injuries of this type, rib protectors have been developed, such as the rib protector described in U.S. Pat. No. 5,029,341. In this patent, the rib protector is designed for use with a conventional shoulder pad having arch members overlying padding. The rib protector includes a pad and a number of plate members fixedly secured to the outside of the pad by straps stitched to the pad. One drawback of this design is that the plates may have a tendency to restrict the mobility of a player wearing the rib protector at his waist and torso. There is no provision in this patent for removing any of the plates or adjusting their positions relative to the pad to alleviate this problem or to suit the preference of the player.

Among the several objects of this invention may be noted the provision of an improved rib protector capable of protecting the torso of a player wearing the protector; the provision of such a rib protector having a plurality of impact-absorbing plates which are individually removable so that a player may select a preferred number of plates for use on the rib protector; the provision of such a rib protector wherein the plates are individually adjustable to selected positions relative to the torso of a player; the provision of such a rib protector which easily attaches to a shoulder pad of standard construction; the provision of such a rib protector which is constructed to permit greater player mobility and flexibility than prior rib protectors; the provision of such a rib protector which is compact and simple in design; and the provision of such a rib protector which is durable in construction and easy to manufacture.

Generally, this invention is directed to a rib protector for protecting a person's torso while playing athletic events, such as football. The rib protector comprises an elongate pad having an inner surface and an outer surface opposite the inner surface. A flexible belt is attached to the outer surface of the pad for securing the pad around the person's torso in a position in which the inner surface of the pad is adjacent the torso. A plurality of substantially rigid plates are adapted to be removably attached to the belt for covering portions of the outer surface of the pad. The plates are constructed for receiving the impact of blows delivered to the rib protector and distributing the impact force to the pad. The plates are separate from one another and individually removable from the belt whereby a person using the rib protector may attach a selected number of plates to the belt.

In another aspect of this invention, the plates are separate from one another and individually adjustable along the length of the belt whereby a person using the rib protector may selectively position the plates relative to the torso of the wearer.

In a third aspect of this invention, the rib protector is equipped with means for releasably connecting the rib protector to a shoulder pad.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
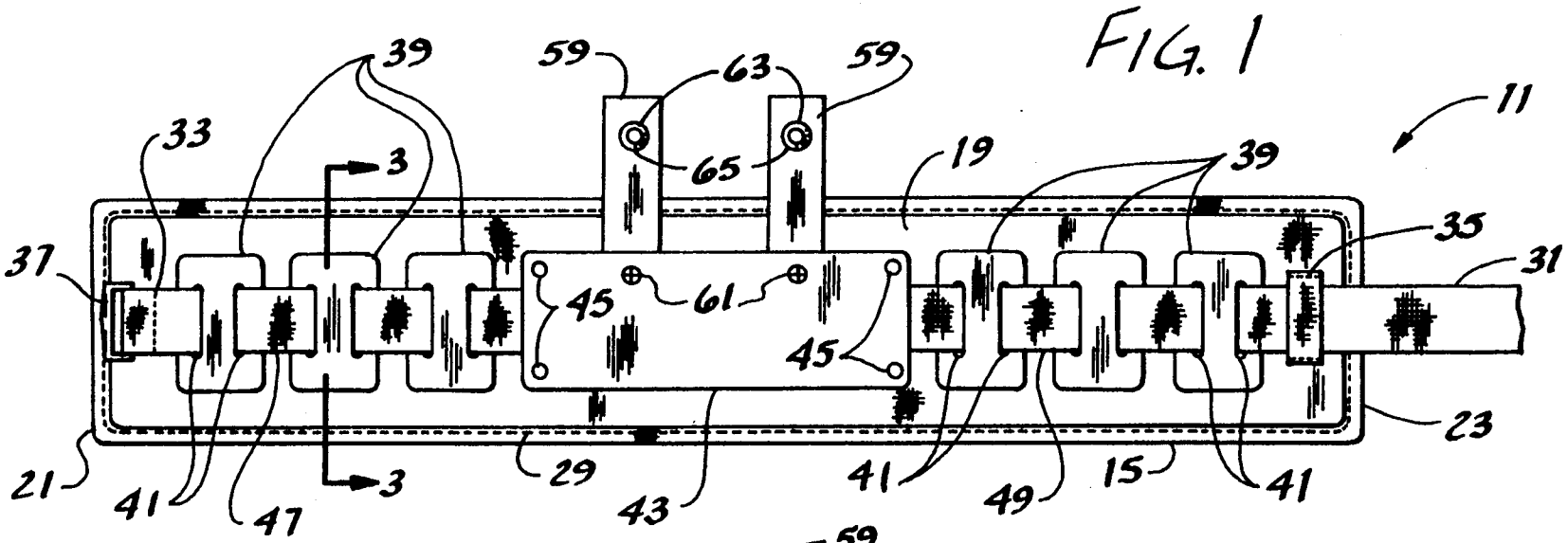
FIG. 1 is an elevational view of one side of a rib protector of the present invention having a number (six) of removable and adjustable plates for receiving the impact of blows delivered to the rib protector.
Figure 5:
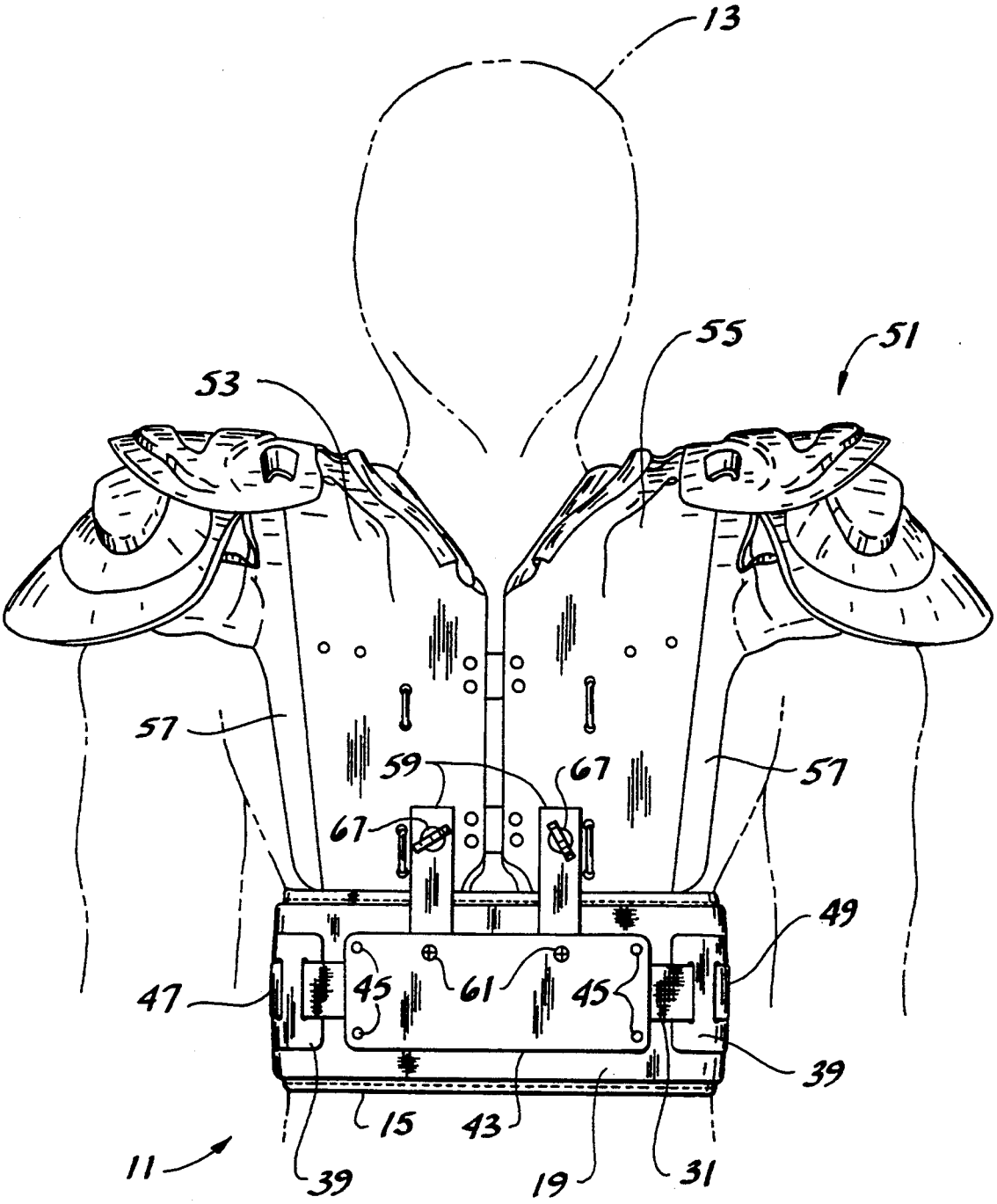
FIG. 5 is a rear view of the rib protector illustrated in FIG. 1 attached to a shoulder pad of standard construction as worn by a player (shown in phantom)
Figure 6:
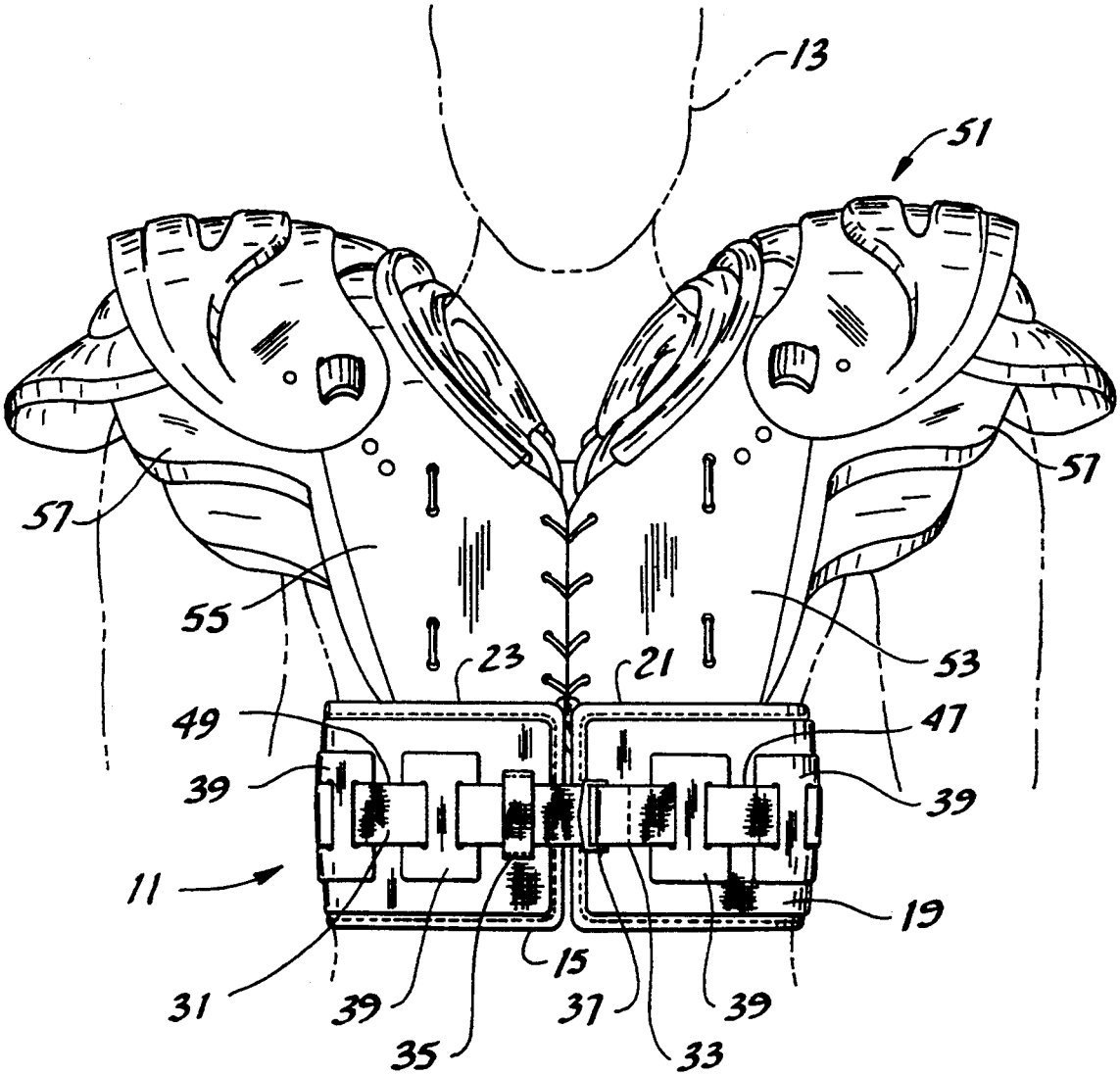
FIG. 6 is a front view of the rib protector and shoulder pad shown in FIG. 5.

Referring now to the drawings, and more particularly to FIGS. 1, 5 and 6, a rib protector of the present invention is generally indicated at 11. The rib protector 11 is worn by a player 13 participating in an athletic event, such as football, for protecting the player's torso, and more specifically, his rib cage. It is to be understood that the rib protector 11 may be worn by players in other sports involving significant physical contact, such as hockey.

Figure 2:
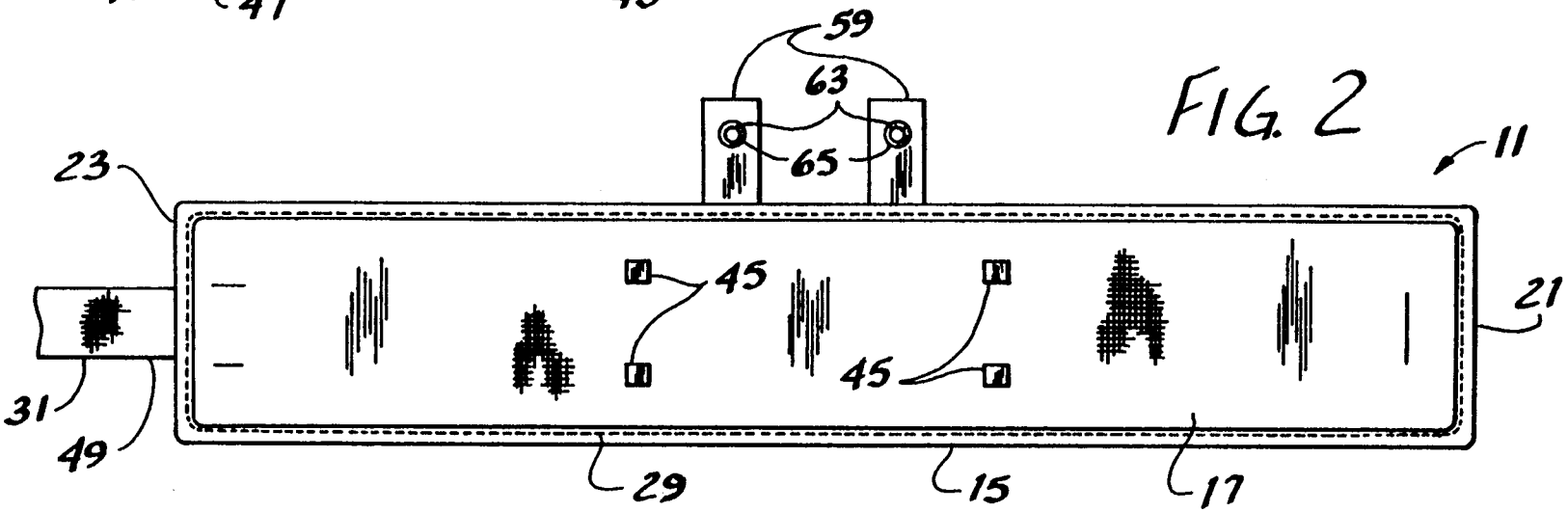
FIG. 2 is an elevational view of the opposite side of the rib protector shown in FIG. 1.
Figure 3:
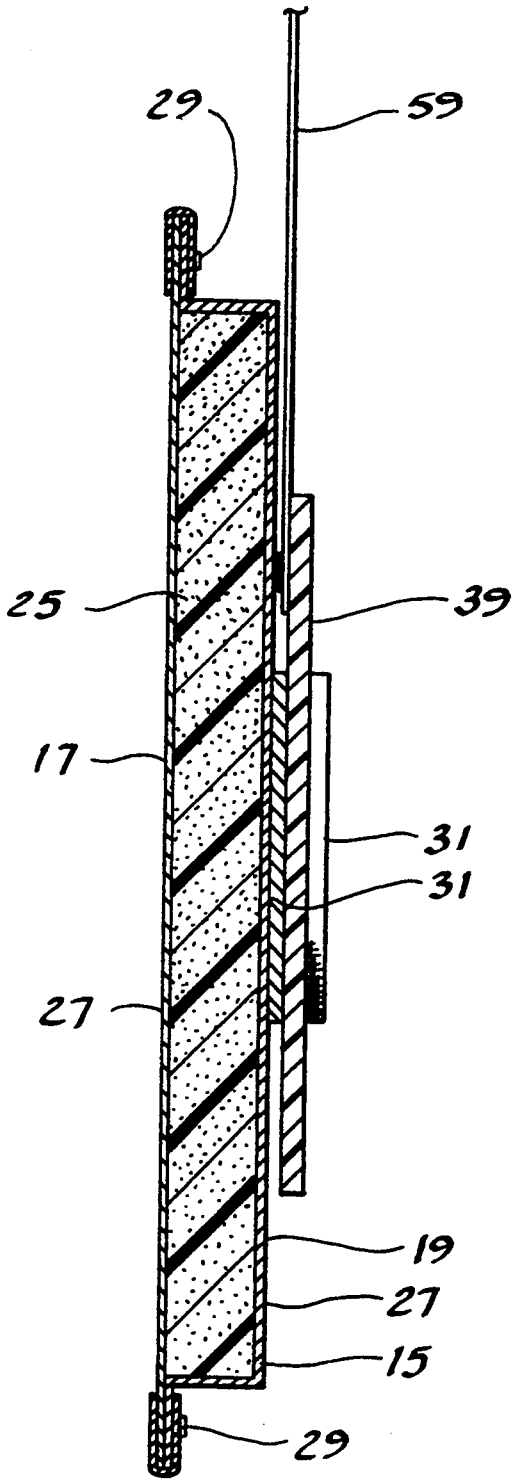
FIG. 3 is an enlarged vertical section taken along line 3—3 of FIG. 1.

As illustrated in FIGS. 1 and 2, the rib protector 11 includes an elongate, generally rectangular pad 15 having an inner surface 17 and an outer surface 19 opposite the inner surface. Opposite ends of the pad 15 are designated 21 and 23; the left-hand end of the pad (as viewed in FIG. 1) being designated 21 and the right-hand end being designated 23. The pad 15 comprises a cushion 25 (FIG. 3) of closed-cell elastomeric vinyl foam material and two panels of sheet material, each designated 27, encasing the cushion. The panels 27 are attached to each other by stitching 29 along their superposed peripheries. The pad 15 is designed for cushioning blows delivered to the player's torso.

A flexible belt 31 made from woven nylon material, for example, extends along the outside surface 19 of the pad 15 for securing the pad around the player's torso in a position in which the inner surface 17 of the pad is adjacent the torso. The belt 31 may be made from materials other than nylon, such as leather. One end of the belt (its left end as viewed in FIG. 1) is permanently attached by stitching 33 to the pad adjacent one (left) end 21 of the pad. The belt is otherwise free of permanent attachment to the pad. The opposite end of the belt extends through a loop 35 secured to the pad adjacent its other (right) end 23. The belt is tightened and secured in place around a player by passing the free end of the belt through a buckle 37 attached to the opposite end of the belt adjacent stitching 33. The buckle 37 is of standard construction for releasably retaining the end of the belt. It is to be understood that other fastening devices, such as snap-acting fasteners or hook and loop fasteners, may be used for tightening the pad 15 around the player's torso.

Figure 4:
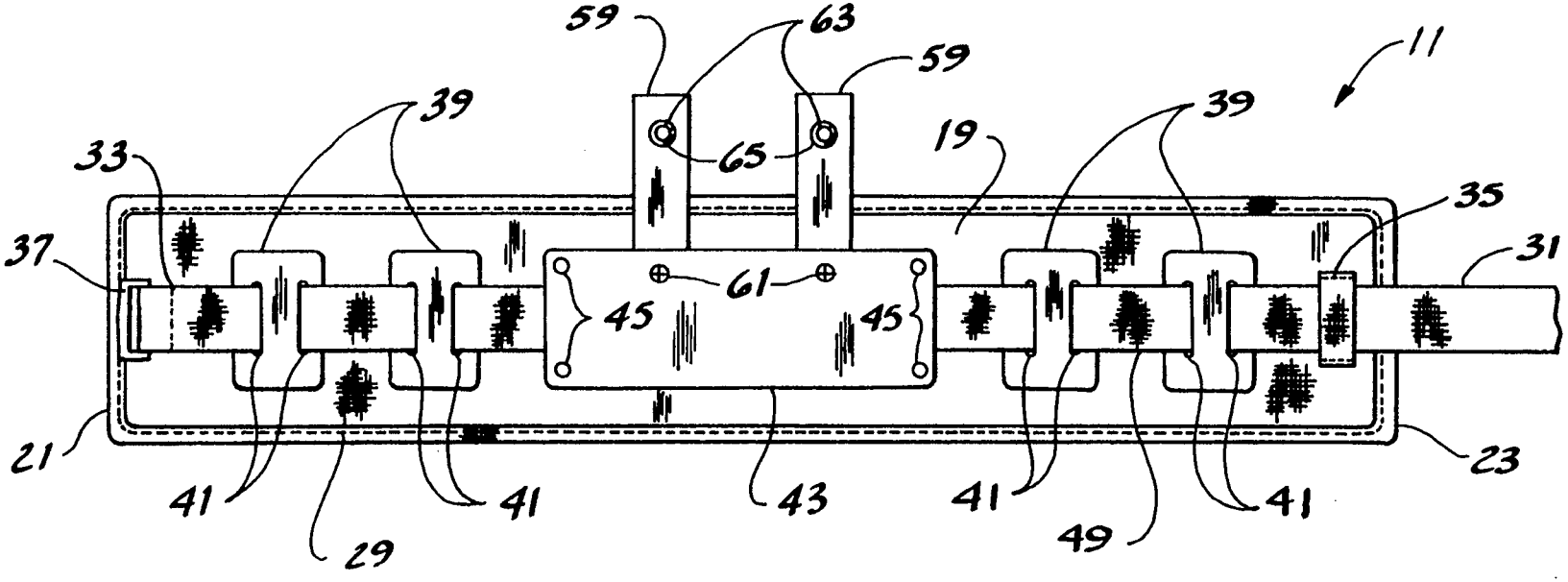
FIG. 4 is a view similar to FIG. 1 showing the rib protector having four removable and adjustable plates.

As illustrated in FIG. 1, the rib protector 11 includes a number of substantially rigid, generally rectangular, relatively thin plates, each designed 39, to be removably attached to the belt 31 for covering portions of the outer surface 19 of the pad 15. The plates 39 are constructed for receiving the impact of blows delivered to the rib protector 11 and distributing the impact force to the pad 15. As shown, the plates 39 are separate from one another and individually removable from the belt 31 so that the player 13 using the rib protector 11 may attach a selected number of plates to the belt. For example, FIG. 1 illustrates six such plates 39 of identical construction being attached to the belt 31, whereas, FIG. 4 illustrates four such plates. Certain factors such as the size of the player, and the desired amount and location of protection, may dictate how many plates 39 are attached to the belt 31. Regardless of how many plates are selected, since the plates are relatively small and separate from one another, the belt is capable of being pulled tight around the pad 15 without substantially restricting the player's mobility (i.e., the ability to turn or bend at the waist and torso) while still providing adequate protection against blows delivered to the player's torso.

Preferably, each plate 39 is made from a suitable tough synthetic resin material (e.g., 0.140-ga. plastic) and has two slots, each designated 41, formed therein for receiving the belt 31. As shown, the two slots 41 formed in each plate 39 are generally parallel to one another. Each slot 41 has a length greater than the width of the belt 31 and a width greater than the thickness of the belt for receiving the belt therethrough. For each plate 39, the belt 31 is threaded through both slots 41 as illustrated in the drawings to securely (but removably) retain the plate on the belt. This arrangement also allows the plates 39 to be individually adjusted along the length of the belt 31 to selected positions relative to the torso of the player 13. Thus, the player has many options in determining where, along the length of the rib protector 11, the plates 39 should be placed.

A substantially rigid, generally rectangular back plate 43 fixedly attached to the outer surface 19 of the pad 15 protects the lower back of the player 13. This back plate 43 is preferably made out of the same material as the removable and adjustable plates 39 and has about the same thickness. Rivets 45, located adjacent the four corners of the back plate, attach the plate to the pad 15. The belt 31 is releasably captured between the pad 15 and the back plate 43 such that a left-hand portion 47 of the belt extends from under the back plate at the left side of the player 13 and a right-hand portion 49 of the belt extends from under the back plate at the right side of the player. The belt extends through a small gap (caused by deformation of the pad) between the back plate 43 and the pad 15. The back plate 43 is positioned so that it does not interfere with the player's mobility. Both the left-hand and right-hand end portions 47, 49 of the belt 31 receive one or more of the removable and adjustable plates 39. As mentioned earlier, FIG. 1 illustrates the rib protector 11 as having three plates 39 on each end portion 47, 49, while FIG. 4 illustrates each end portion as having two plates thereon.

The rib protector 11 is assembled by attaching a desired number of removable and adjustable plates 39 on the left-hand portion 47 of belt 31 in a position where they protect the left-hand side of the player 13 (i.e., in a position to the left of the back plate 43). Each plate 39 is attached by threading the free end of the belt 31 through the two slots 41 provided in the plate 39 in the manner illustrated in the drawings. The free end of the belt 31 is then threaded between the back plate 43 and the pad 15 (and between the rivets 45 securing the back plate to the pad) and pulled taught so that there is no slack in the belt. These plates 39 may then be adjusted along the length of the belt to the desired locations. Preferably the same number of plates 39 that were attached to the left-hand portion 47 of the belt 31 are attached to the right-hand portion 49 of the belt in the same manner. These plates 39 may also be adjusted along the length of the belt 31 to desired locations. It is to be understood that the right-hand and left-hand portions 47, 49 of the belt 31 do not require the same number of plates 39, but can have differing numbers of plates. The free end of the belt 31 is then passed through the loop 35 whereupon the rib protector 11 is ready for use by the player 13. The rib protector is secured in place around the torso by securing the free end of the belt in the buckle 37.

Referring now to FIGS. 5 and 6, a rib protector 11 of the present invention is illustrated as being attached to a shoulder pad generally indicated at 51. The shoulder pad is of standard construction and includes a left-hand shell member 53 adapted to fit over the left shoulder of the player and a right-hand shell member 55 adapted to fit over the right shoulder of a player. Each of the shell members 53, 55 is of inverted U-shape as viewed from the side and both members combine to constitute a protective shell for the player. Pad members 57 of cushioning material are attached (by stitching or by releasable connectors, for example) to the inside surfaces of the shell members for cushioning blows delivered to the shell.

The rib protector 11 has two stiff but somewhat flexible spaced-apart straps (broadly referred to as "connecting means") for releasably connecting the rib protector to the shoulder pad 51. It is to be understood, however, that the rib protector of the present invention does not have to be connected to the shoulder pad. The straps 59 may be made from a suitable plastic material, for example. One end of each strap 59 is fixedly attached to the back plate 43 (e.g., by a screw 61) and the other end of each strap 59 has an opening 63 formed therein for releasable connection to the shell of the shoulder pad. A metal grommet 65 reinforces each opening 63. The opening 63 has a diameter for receiving the shank (not shown) of a T-bolt 67 therethrough. The threaded shank of the T-bolt 67 is screwed into a threaded opening (not shown) formed in the shell of the shoulder pad 51 (as by a threaded insert punched into the shell of the shoulder pad). Other fastening devices may be used for attaching the straps 59 of the rib protector 11 to the shell of the shoulder pad 51, such as snap-acting fasteners or hook and loop fastening material, for example. The arrangement is such that the rib protector 11 is suspended from the shoulder pad 51 at an appropriate position relative to the torso for protecting the player's rib cage. It will be understood that the height of the rib protector relative to the shoulder pad may be varied by varying the length of the straps 59. In any event, the shoulder pad 51 and rib protector 11 combine to protect a substantial portion of the player's torso and upper body as clearly illustrated in FIGS. 5 and 6.

It will be observed that the rib protector 11 of the present invention allows freedom of movement at the player's waist and torso while providing the desired amount of protection to the player's torso. By simply selecting the number of removable and adjustable plates 39 and spacing them at desired locations along the length of the belt 31, the player 13 may configure the rib protector 11 to meet personal criteria.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rib protector for protecting a person's torso while playing athletic events, such as football, the rib protector comprising:

an elongate pad having an inner surface and an outer surface opposite the inner surface;

a flexible belt attached to the outer surface of the pad for securing the pad around the person's torso in a position in which the inner surface of the pad is adjacent the torso; and a plurality of substantially rigid plates adapted to be removably attached to the belt for covering portions of the outer surface of the pad, the plates being constructed for receiving the impact of blows delivered to the rib protector and distributing the impact force to the pad, said plates being separate from one another and individually removable from the belt whereby a person using the rib protector may attach a selected number of plates to the belt.

2. A rib protector as set forth in claim 1 wherein said removable plates are individually adjustable along the length of the belt to selected positions relative to the torso of the wearer.

3. A rib protector as set forth in claim 1 further comprising a substantially rigid back plate fixedly attached to the outer surface of the pad in a position where it protects the lumbar region of the person wearing the rib protector, the belt being captured between the pad and the back plate and having a left-hand portion extending from under the back plate at the left side of the torso of the wearer and a right-hand portion extending from under the back plate at the right side of the torso, each of said left-hand and right-hand portions having one or more of said removable plates secured thereto.

4. A rib protector as set forth in claim 3 further comprising means for releasably connecting the rib protector to a shoulder pad.

5. A rib protector as set forth in claim 4 wherein said connecting means comprises two relatively flexible, spaced-apart straps, one end of each strap being attached to the back plate and the other end of each strap being adapted for releasable connection to a shell of the shoulder pad.

6. A rib protector as set forth in claim 1 wherein each removable plate has two slots formed therein adapted for receiving the belt therethrough to securely retain the plate to the belt.

7. A rib protector as set forth in claim 1 wherein the pad comprises a cushion and two panels of sheet material stitched together at their peripheries to encase the cushion.

8. A rib protector as set forth in claim 1 wherein the removable plates are made from synthetic resin material.

9. A rib protector for protecting a person's torso while playing athletic events, such as football, the rib protector comprising:

an elongate pad having an inner surface and an outer surface opposite the inner surface;

a flexible belt attached to the outer surface of the pad for securing the pad around the person's torso in a position in which the inner surface of the pad is adjacent the torso; and a plurality of substantially rigid plates adapted to be adjustably attached to the belt for covering portions of the outer surface of the pad, the plates being constructed for receiving the impact of blows delivered to the rib protector and distributing the impact force to the pad, said plates being separate from one another and individually adjustable along the length of the belt whereby a person using the rib protector may selectively position the plates relative to the torso of the wearer.

10. A rib protector as set forth in claim 9 wherein said adjustable plates are individually removable from the belt for enabling a person using the rib protector to attach a selected number of plates to the belt.

11. A rib protector as set forth in claim 9 further comprising a substantially rigid back plate fixedly attached to the outer surface of the pad in a position where it protects the lumbar region of the person wearing the rib protector, the belt being captured between the pad and the back plate and having a left-hand portion extending from under the back plate at the left side of the torso of the wearer and a right-hand portion extending from under the back plate at the right side of the torso, each of said left-hand and right-hand portions having one or more of said adjustable plates secured thereto.

12. A rib protector as set forth in claim 11 further comprising means for releasably connecting the rib protector to a shoulder pad.

13. A rib protector as set forth in claim 12 wherein said connecting means comprises two relatively flexible, spaced-apart straps, one end of each strap being attached to the back plate and the other end of each strap being adapted for releasable connection to a shell of the shoulder pad.

14. A rib protector as set forth in claim 9 wherein each adjustable plate has two slots formed therein adapted for receiving the belt therethrough to securely retain the plate to the belt.

15. A rib protector as set forth in claim 9 wherein the pad comprises a cushion and two panels of sheet material stitched together at their peripheries to encase the cushion.

16. A rib protector as set forth in claim 9 wherein the adjustable plates are made from synthetic resin material.

17. A rib protector adapted for releasable connection to a shoulder pad of the type comprising a left-hand shell member adapted to fit over the left shoulder of a wearer and a right-hand shell member adapted to fit over the right shoulder of a wearer, each of said shell members being of inverted U-shape as viewed from the side and combining to constitute a protective shell for the player, and pad members disposed on inside surfaces of the shell members for cushioning blows delivered to the shell, the rib protector comprising:

an elongate pad having an inner surface and an outer surface opposite the inner surface;

a flexible belt attached to the outer surface of the pad for securing the pad around the person's torso in a position in which the inner surface of the pad is adjacent the torso;

a plurality of substantially rigid plates adapted to be removably attached to the belt for covering portions of the outer surface of the pad, the plates being constructed for receiving the impact of blows delivered to the rib protector and distributing the impact force to the pad, said plates being separate from one another and individually removable from the belt whereby a person using the rib protector may attach a selected number of plates to the belt; and means for releasably connecting the rib protector to the shoulder pad.

18. A rib protector as set forth in claim 17 wherein said connecting means is adapted for connection to said shell of the shoulder pad.

19. A rib protector as set forth in claim 18 wherein said connecting means comprises two relatively flexible, spaced-apart straps, one end of each strap being attached to the back plate and the other end of each strap being adapted for releasable connection to the shell of the shoulder pad.

20. A rib protector as set forth in claim 17 wherein said removable plates are individually adjustable along the length of the belt to selected positions relative to the torso of the wearer.

21. A rib protector as set forth in claim 17 further comprising a substantially rigid back plate fixedly attached to the outer surface of the pad in a position where it protects the lunar region of the person wearing the rib protector, the belt being captured between the pad and the back plate and having a left-hand portion extending from under the back plate at the left side of the torso of the wearer and a right-hand portion extending from under the back plate at the right side of the torso, each of said left-hand and right-hand portions having one or more of said removable plates secured thereto.

22. A rib protector as set forth in claim 17 wherein each removable plate has two slots formed therein adapted for receiving the belt therethrough to securely retain the plate to the belt.

* * * * *